US010990049B2

(12) United States Patent
Fujiwara

(10) Patent No.: US 10,990,049 B2
(45) Date of Patent: Apr. 27, 2021

(54) DRIVER, FIXING DEVICE, AND IMAGE FORMING APPARATUS

(71) Applicant: Hitoshi Fujiwara, Kanagawa (JP)

(72) Inventor: Hitoshi Fujiwara, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/938,116

(22) Filed: Jul. 24, 2020

(65) Prior Publication Data

US 2021/0041820 A1 Feb. 11, 2021

(30) Foreign Application Priority Data

Aug. 7, 2019 (JP) ..... JP2019-145739

(51) Int. Cl.
*G03G 15/20* (2006.01)
*G03G 15/16* (2006.01)

(52) U.S. Cl.
CPC ..... *G03G 15/2064* (2013.01); *G03G 15/1615* (2013.01); *G03G 15/2053* (2013.01); *G03G 2215/2038* (2013.01)

(58) Field of Classification Search
CPC ..... G03G 15/1615; G03G 15/2053; G03G 15/2064; G03G 2215/2038
See application file for complete search history.

(56) References Cited

U.S. PATENT DOCUMENTS 5,708,927 A * 1/1998 Etoh ..... G03G 15/2064 399/122
8,412,072 B2 * 4/2013 Senda ..... G03G 15/206 399/122
2006/0133869 A1 * 6/2006 Sata ..... G03G 15/2032 399/329
2013/0064586 A1 3/2013 Adachi et al.
2013/0251422 A1 9/2013 Iwaya et al.
2014/0056625 A1 2/2014 Naitoh et al.
(Continued)

FOREIGN PATENT DOCUMENTS

JP 2013-195858 9/2013
JP 2018-194695 12/2018

OTHER PUBLICATIONS

U.S. Appl. No. 16/750,066, filed Jan. 23, 2020. Hitoshi Fujiwara.
(Continued)

*Primary Examiner* — Gregory H Curran
(74) *Attorney, Agent, or Firm* — Harness, Dickey & Pierce, P.L.C.

(57) ABSTRACT

A driver includes a first rotator, a second rotator, a bearing, a housing, a drive gear, a first idler gear, a pivot member, and a second idler gear. The first idler gear is meshed with the drive gear. The pivot member rotates around a rotation center axis in the housing and includes an idler gear support portion rotatably holding the first idler gear. The second idler gear is meshed with the first idler gear and disposed on the rotation center axis of the pivot member. A rotation center of the pivot member is present in a region outside a circle having a diameter of 1.5×L and inside a circle having a diameter of 1.8×L around a rotation center of the first idler gear, when a distance between a rotation center of the first rotator and the rotation center of the first idler gear is L.

9 Claims, 9 Drawing Sheets

(56) References Cited

U.S. PATENT DOCUMENTS

| | | | |
|---|---|---|---|
| 2014/0072354 | A1 | 3/2014 | Toyoda et al. |
| 2014/0093288 | A1 | 4/2014 | Naitoh et al. |
| 2014/0099146 | A1 | 4/2014 | Fujii et al. |
| 2014/0112691 | A1 | 4/2014 | Nanno et al. |
| 2014/0153982 | A1 | 6/2014 | Adachi et al. |
| 2014/0153983 | A1 | 6/2014 | Fujii et al. |
| 2015/0248091 | A1 | 9/2015 | Nanno et al. |
| 2015/0346662 | A1 | 12/2015 | Kawarasaki et al. |
| 2016/0378028 | A1 | 12/2016 | Fujiwara et al. |

OTHER PUBLICATIONS

U.S. Appl. No. 16/811,955, filed Mar. 6, 2020. Yoshiharu Takahashi, et al.

* cited by examiner

DRIVER, FIXING DEVICE, AND IMAGE FORMING APPARATUS

CROSS-REFERENCE TO RELATED APPLICATION

This patent application is based on and claims priority pursuant to 35 U.S.C. § 119(a) to Japanese Patent Application No. 2019-145739, filed on Aug. 7, 2019, in the Japan Patent Office, the entire disclosure of which is hereby incorporated by reference herein.

BACKGROUND

Technical Field

The present disclosure relates to a driver, a fixing device, and an image forming apparatus.

Description of the Related Art

There is known an image forming apparatus including a fixing device that forms a toner image on a recording medium and presses and heats the toner image to fix the image.

In such a fixing device, a nip forming member such as a pair of rollers is used to sandwich a recording medium and apply pressure and heat to the recording medium. In a driver in which a gear is attached to a roller shaft to drive a roller, it is known that such rollers forming a nip are subjected to a pull-in force to be pulled in a nip direction by a driving force.

Typically, since the driver drives a roller on one end of the roller, the pull-in force is also biased on the one end. Such a load difference may cause an abnormal image or a decrease in durability.

Hence, some drivers have been proposed that include a pull-in force cancelling mechanism to reduce the pull-in force on a roller shaft of a roller such as the nip formation member.

SUMMARY

In an aspect of the present disclosure, a driver includes a first rotator, a second rotator, a bearing, a housing, a drive gear, a first idler gear, a pivot member, and a second idler gear. The second rotator forms a nip with the first rotator. The bearing holds rotatably a shaft portion of the first rotator. The housing holds the bearing such that the first rotator is movable along a direction to contact and separate from the second rotator. The drive gear is provided on the shaft portion of the first rotator and rotates together with the first rotator. The first idler gear is meshed with the drive gear. The pivot member rotates around a rotation center axis in the housing and includes an idler gear support portion rotatably holding the first idler gear. The second idler gear is meshed with the first idler gear and disposed on the rotation center axis of the rotator. A rotation center of the rotating member is present in a region outside a circle having a diameter of 1.5×L and inside a circle having a diameter of 1.8×L around a rotation center of the first idler gear, when a distance between a rotation center of the first rotator and the rotation center of the first idler gear is defined as L.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
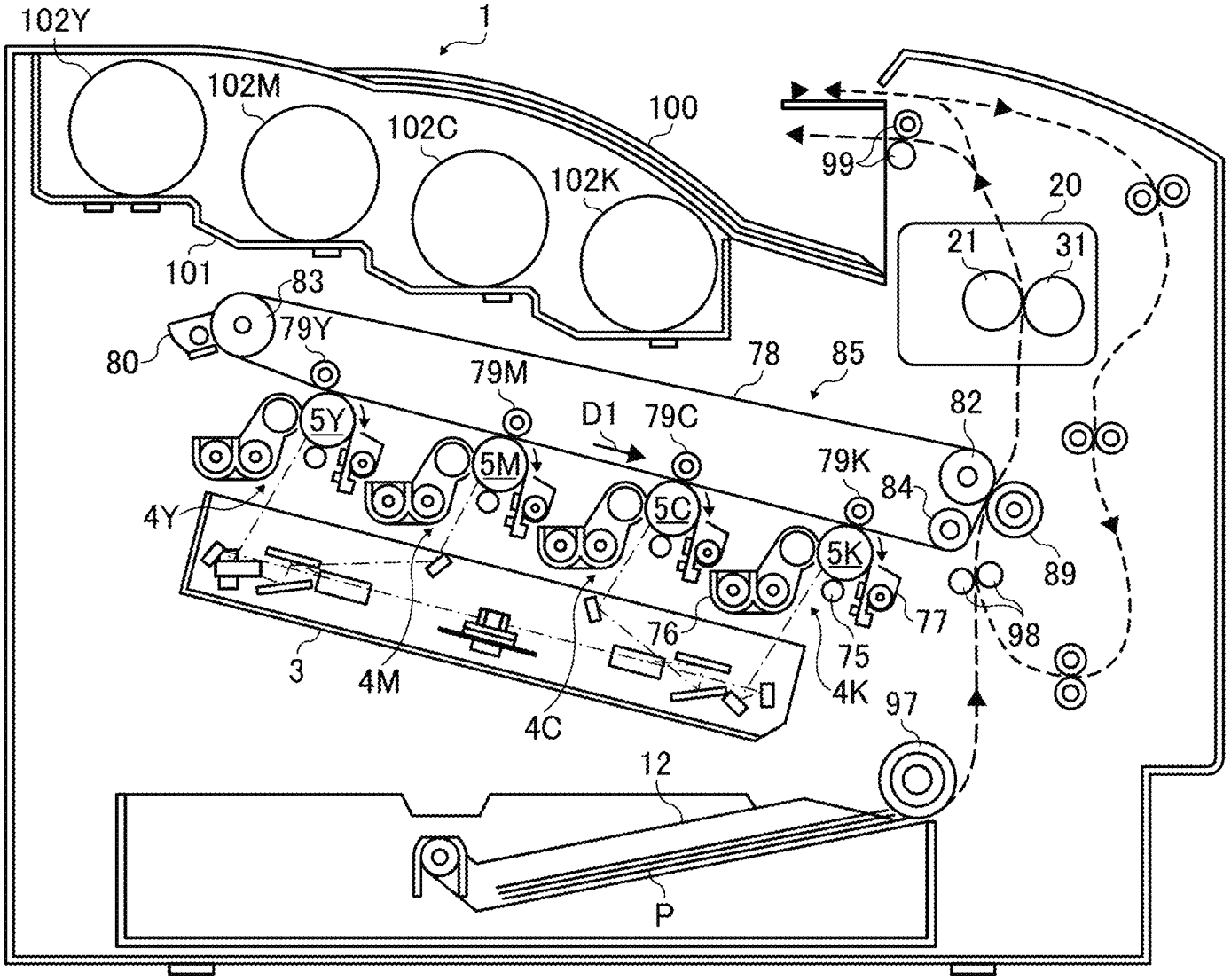
FIG. 1 is a schematic view of an overall configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of the present disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

FIG. 1 is a schematic view of an overall configuration of an image forming apparatus 1 as an example of embodiments of the present disclosure.

The image forming apparatus 1 including a fixing device 20 according to a first embodiment of the present disclosure is a tandem-type color printer that copies, prints, or the like using toner as a recording material to form an image on a sheet P as an example of a recording medium.

As illustrated in FIG. 1, the image forming apparatus 1 according to the first embodiment is a tandem-type color printer. The image forming apparatus 1 includes a bottle container 101 disposed in an upper part of an apparatus body, and four toner bottles 102Y, 102M, 102C, and 102K corresponding to four colors of yellow, magenta, cyan, and black, respectively, accommodated in the bottle container 101.

The image forming apparatus 1 includes an intermediate transfer unit 85, an intermediate transfer belt 78, image forming units 4Y, 4M, 4C, and 4K corresponding to respective colors (yellow, magenta, cyan, and black) facing the intermediate transfer belt 78, and an exposure unit 3 as an optical writing unit that exposes a photoconductor using a laser beam.

The image forming apparatus 1 includes a sheet feeding unit 12, a sheet feeding roller 97, and a registration roller pair 98. The sheet feeding unit 12 is disposed in a lower part of the apparatus body and stores a plurality of sheets P as recording media in a stacked manner. The registration roller pair 98 conveys the sheet P from the sheet feeding unit 12.

The image forming apparatus 1 includes the fixing device 20 that heats and presses a toner image formed on the sheet P to fix the toner image on the sheet P, and a sheet ejection roller pair 99 that ejects the sheet P, on which the image has been fixed, to a stack section 100 provided outside the image forming apparatus 1.

The toner bottles 102Y, 102M, 102C, and 102K are detachably installed in the bottle container 101. That is, the toner bottles 102Y, 102M, 102C, and 102K are replaceable.

The intermediate transfer unit 85 is disposed below the bottle container 101. The image forming units 4Y, 4M, 4C, and 4K corresponding to the respective colors (yellow, magenta, cyan, and black) are arranged side by side to face the intermediate transfer belt 78 of the intermediate transfer unit 85.

The image forming units 4Y, 4M, 4C, and 4K include photoconductor drums 5Y, 5M, 5C, and 5K, respectively.

A set of a charger 75, a developing unit 76, a cleaner 77, a discharger, and the like is disposed around each of the photoconductor drums 5Y, 5M, 5C, and 5K.

An image forming process (a charging step, an exposure step, a developing step, a transfer step, and a cleaning step) is performed on each of the photoconductor drums 5Y, 5M, 5C, and 5K, and the respective color images are formed on the photoconductor drums 5Y, 5M, 5C, and 5K.

The photoconductor drums 5Y, 5M, 5C, and 5K are driven by a driving motor to rotate in a clockwise direction in FIG. 1.

The chargers 75 uniformly charge surfaces of the photoconductor drums 5Y, 5M, 5C, and 5K (charging step).

When the surfaces of the photoconductor drums 5Y, 5M, 5C, and 5K reach positions irradiated by laser light L emitted from the exposure unit 3, electrostatic latent images corresponding to the respective colors are formed by exposure scanning at the irradiated positions (exposure step).

The electrostatic latent images are developed by movement of toner at positions on the surfaces of the photoconductor drums 5Y, 5M, 5C, and 5K facing the developing units 76, and toner images of the respective colors are formed (developing step).

The surfaces of the photoconductor drums 5Y, 5M, 5C, and 5K reach positions facing the intermediate transfer belt 78 and primary transfer bias rollers 79Y, 79M, 79C, and 79K, respectively. At the positions, the toner images on the photoconductor drums 5Y, 5M, 5C, and 5K are transferred onto the intermediate transfer belt 78 (primary transfer step).

A small amount of untransferred toner remains on the photoconductor drums 5Y, 5M, 5C, and 5K. When each of the surfaces of the photoconductor drums 5Y, 5M, 5C, and 5K reaches a position facing the cleaner 77, the untransferred toner remaining on each of the photoconductor drums 5Y, 5M, 5C, and 5K at the position is mechanically collected by a cleaning blade of the cleaner 77 (cleaning step).

Finally, each of the surfaces of the photoconductor drums 5Y, 5M, 5C, and 5K reaches a position at which the discharger is disposed opposite each of the photoconductor drums 5Y, 5M, 5C, and 5K, respectively, and the dischargers eliminate residual potential from the photoconductor drums 5Y, 5M, 5C, and 5K.

Thus, a series of image forming process performed on the photoconductor drums 5Y, 5M, 5C, and 5K is completed.

The toner images of the respective colors formed on the photoconductor drums 5Y, 5M, 5C, and 5K through the developing step are transferred onto the intermediate transfer belt 78 in a superimposed manner to form a color image on the intermediate transfer belt 78.

The intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, an intermediate transfer cleaner 80, and the like.

The intermediate transfer belt 78 is stretched and supported by three rollers, the secondary transfer backup roller 82, the cleaning backup roller 83, and the tension roller 84, and is endlessly moved in a direction indicated by arrow D1 in FIG. 1 by rotational driving of one of the three rollers, the secondary transfer backup roller 82.

The four primary transfer bias rollers 79Y, 79M, 79C, and 79K sandwich the intermediate transfer belt 78 between the primary transfer bias rollers 79Y, 79M, 79C, and 79K and the photoconductor drums 5Y, 5M, 5C, and 5K, respectively, to form primary transfer nips.

Since a transfer bias opposite to the polarity of toner is applied to the primary transfer bias rollers 79Y, 79M, 79C, and 79K, the toner images are transferred when the surfaces of the photoconductor drums 5Y, 5M, 5C, and 5K reach positions facing the primary transfer bias rollers 79Y, 79M, 79C, and 79K, respectively.

The intermediate transfer belt 78 travels in the direction indicated by arrow D1 in FIG. 1 and sequentially passes through the primary transfer nips of the primary transfer bias rollers 79Y, 79M, 79C, and 79K.

In this manner, the toner images of the respective colors on the photoconductor drums 5Y, 5M, 5C, and 5K are transferred onto the intermediate transfer belt 78 in a superimposed manner (primary transfer).

The intermediate transfer belt 78 onto which the toner images of the respective colors are transferred in a superimposed manner reaches a position facing a secondary transfer roller 89. At the position facing the secondary transfer roller 89, that is, the secondary transfer position, the secondary transfer backup roller 82 and the secondary transfer roller 89 sandwich the intermediate transfer belt 78 therebetween to form a secondary transfer nip.

The four color toner images formed on the intermediate transfer belt 78 are transferred onto a sheet P as a recording medium conveyed to the position of the secondary transfer nip.

On the intermediate transfer belt 78 that has passed through the secondary transfer position, untransferred toner not transferred to the sheet P as the recording medium remains. When the intermediate transfer belt 78 reaches a position of the intermediate transfer cleaner 80, the intermediate transfer cleaner 80 collects the untransferred toner on the intermediate transfer belt 78.

Thus, a series of image transfer processes performed on the intermediate transfer belt 78 is completed.

The sheet P conveyed to the position of the secondary transfer nip is conveyed from the sheet feeding unit 12 disposed in the lower part of the image forming apparatus 1 via the sheet feeding roller 97, the registration roller pair 98, and the like.

A configuration of the sheet feeding is described. A plurality of sheets P such as transfer sheets are stacked and stored in the sheet feeding unit 12, and the sheet feeding roller 97 is driven to rotate in a counterclockwise direction in FIG. 1, so that an uppermost sheet P is fed toward between rollers of the registration roller pair 98.

The registration roller pair 98 conveys the sheet P and the sheet P stops temporarily at a position of a roller nip of the registration roller pair 98 having stopped rotating.

The registration roller pair 98 is driven to rotate in synchronization with the color image on the intermediate transfer belt 78, the sheet P is conveyed toward the secondary transfer nip, and the four color toner image formed on the intermediate transfer belt 78 is transferred as described above.

The sheet P onto which the color image has been transferred at the position of the secondary transfer nip is conveyed to the fixing device 20.

The fixing device 20 includes a fixing belt 21 and a pressure roller 31.

The fixing belt 21 and the pressure roller 31 form a fixing nip, and a toner image transferred onto the surface of the sheet P is pressed and heated by the fixing belt 21 and the pressure roller 31 to be fixed as a color image.

After the sheet P passes through the fixing device 20, the sheet P is ejected outside of the image forming apparatus 1 through rollers of the sheet ejection roller pair 99. The sheets P as the recording medium ejected by the sheet ejection roller pair 99 outside of the image forming apparatus 1 are sequentially stacked as output images on the stack section 100.

The above is a series of image forming processes in the image forming apparatus 1.

The configuration and operation of the fixing device 20 provided in the image forming apparatus 1 are described in detail with reference to FIGS. 2 to 4.

Figure 2:
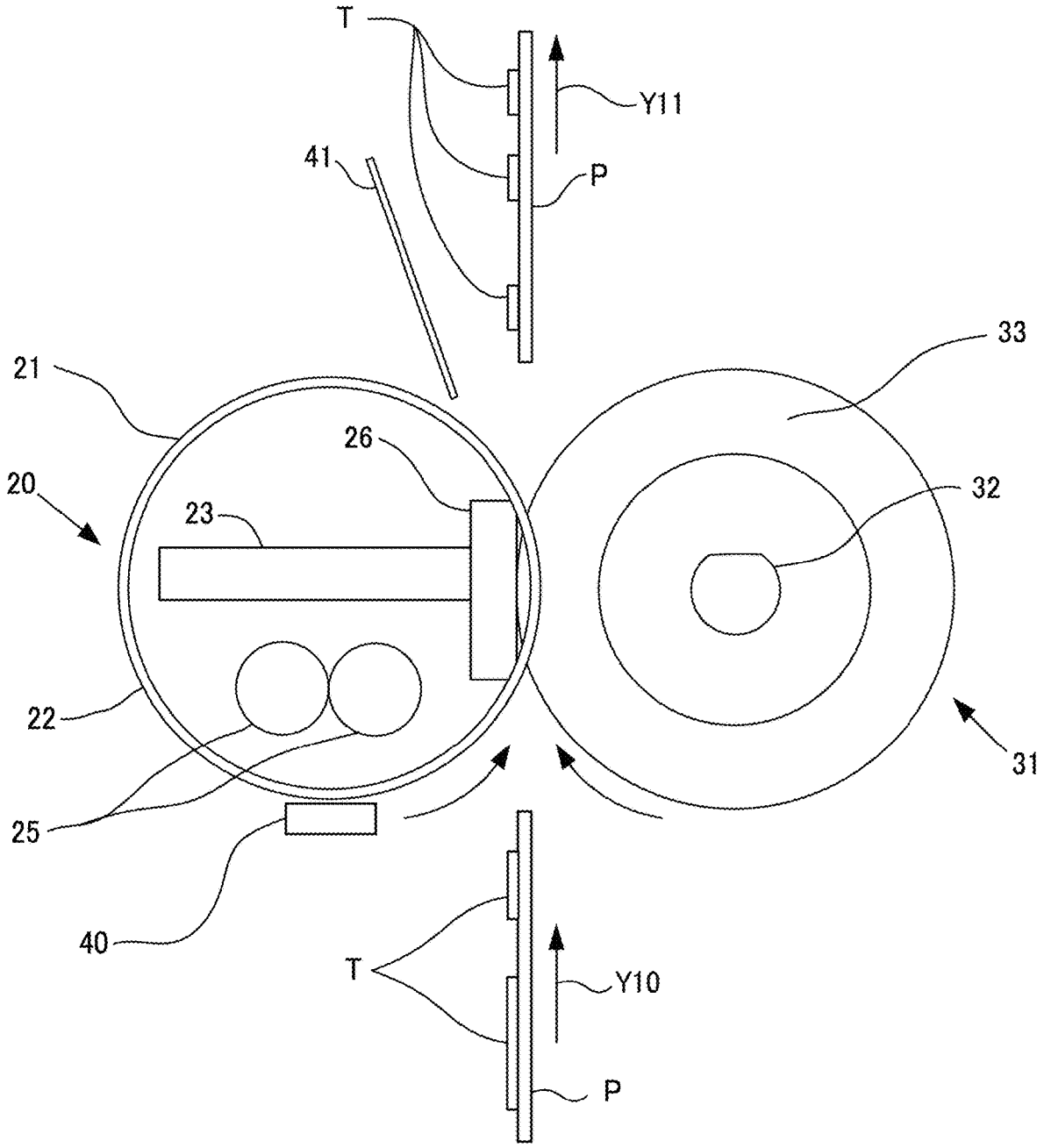
FIG. 2 is a diagram of a fixing device of the image forming apparatus illustrated in FIG. 1.

As illustrated in FIG. 2, the fixing device 20 includes the fixing belt 21, a securing member 26, a heating member 22, a support member 23, heaters 25, the pressure roller 31, a temperature sensor 40, and a separator 41. The fixing belt 21 is a belt serving as a second rotator. The support member 23 functions as a reinforcing member of the securing member 26. The heaters 25 are heating sources. The pressure roller 31 is a first rotator.

The fixing device 20 also includes a housing 50, a pressure lever 51, and a pressure spring 52. The pressure lever 51 is a pressing mechanism attached to the housing 50 and functions as a biasing unit that biases the pressure roller 31 so that the pressure roller 31 is pressed against the fixing belt 21. The pressure spring 52 has one end attached to the housing 50 and biases the pressure lever 51 toward the pressure roller 31. In the present embodiment, the housing 50 is a side plate of the housing, but may be another housing as long as the housing 50 is a portion immovable with respect to the installation surface.

The fixing belt 21 and the pressure roller 31 form a fixing nip when the pressure roller 31 is biased toward the fixing belt 21 by the pressure spring 52 and the pressure lever 51.

The fixing belt 21 is a thin and flexible endless belt, and rotates counterclockwise in FIG. 2.

In the fixing belt 21, a base material layer, an elastic layer, and a release layer are sequentially laminated from an inner circumferential surface of the fixing belt 21, and the entire thickness of the fixing belt 21 is designed to be not greater than 1 mm. The base material layer is formed of a metal such as nickel or stainless steel having a layer thickness of 30 to 100 μm or a resin such as polyimide. The elastic layer has a layer thickness of 100 to 300 μm and is formed of a rubber such as silicone rubber, silicone rubber foam, or fluoro rubber. By the elastic layer, minute asperities of the surface of the fixing belt 21 in the fixing nip is alleviated, and heat is uniformly transmitted to a toner image T on the sheet P, so that the occurrence of a so-called orange peel image or the like is restrained.

The release layer has a layer thickness of 10 to 50 μm and is formed of a material such as tetrafluoroethylene-perfluoroalkyl vinyl ether copolymer (PFA), polytetrafluoroethylene (PTFE), polyimide, polyetherimide, or polyether sulfide (PES).

Such a release layer can ensure releasability (peelability) from the toner image.

The diameter of the fixing belt 21 is about 30 mm in the present embodiment, but is not limited thereto, and may be set to, for example, 15 to 120 mm.

The pressure roller 31 is a pressing rotator that contacts an outer circumferential surface of the fixing belt 21 to form a fixing nip.

The pressure roller 31 is a tubular rotator having a diameter of about 30 to 40 mm and includes a core metal 32 and an elastic layer 33 formed around the core metal 32.

The elastic layer 33 is made of a material such as silicone rubber foam, silicone rubber, or fluoro rubber. A thin release layer made of PFA, PTFE or the like may be provided on a surface layer of the elastic layer 33.

The securing member 26 is made of a heat-resistant resin such as a liquid crystal polymer. Providing an elastic member such as silicone rubber or fluorine rubber between the securing member 26 and the fixing belt 21 enables the surface of the fixing belt 21 to follow minute asperities of the surface of the sheet P in the fixing nip and heat to be uniformly transmitted to the toner image on the sheet P, thus preventing an orange peel image.

The securing member 26 is formed to have a concave cross-sectional shape so that a surface of the securing member 26 facing the pressure roller 31 follows the curvature of the pressure roller 31. With such a configuration, since the sheet P is sent out from the fixing nip to follow the curvature of the pressure roller 31, a situation in which the sheet P after the fixing step is attracted to the fixing belt 21 and not separated from the fixing belt 21 is restrained.

The shape of the securing member 26 forming the nip may be formed in a planar shape or may be formed to continuously change from a planar shape to a concave shape.

When the shape of the nip becomes substantially parallel to an image surface of the sheet P by forming the nip in an arbitrary shape, wrinkling of the sheet P can be prevented.

In addition, forming the cross-section of the securing member 26 close to a concave cross-sectional shape enhances adhesion performance between the fixing belt 21 and the sheet P, and the fixing performance is improved.

Further, since the curvature of the fixing belt 21 at an exit of the nip becomes large, the sheet P fed from the nip can be easily separated from the fixing belt 21.

The heating member 22 is a pipe-shaped member having a thickness of not greater than 0.2 mm. As a material of the heating member 22, a metal thermal conductor (a metal having thermal conductivity) such as aluminum, iron, or stainless steel can be used. Setting the thickness of the heating member 22 not greater than 0.2 mm enables the heating member 22 to be formed to be close to or contact the inner circumferential surface of the fixing belt 21. A portion of the heating member 22 in a position in which the nip is formed is formed to have a concave shape. An inside of the portion of the heating member 22 is formed to have a concave shape and a concave portion is provided in which an opening is formed. In the above configuration, a gap A between the fixing belt 21 and the heating member 22 at the normal temperature (the gap A is a gap of a portion between the fixing belt 21 and the heating member 22 excluding a portion in which the nip is formed) is preferably larger than 0 mm and not greater than 1 mm (0 mm<A≤1 mm).

According to such a configuration, since an area in which the heating member 22 and the fixing belt 21 contact each other in sliding is large, acceleration of the wear of the fixing belt 21 can be prevented. Also, reduction of the heating efficiency of the fixing belt 21 due to the heating member 22 and the fixing belt 21 being excessively separated from each other can be restrained.

Further, since the heating member 22 is provided close to the fixing belt 21, the circular shape of the fixing belt 21 having flexibility is maintained to some extent, and thus deterioration or damage due to deformation of the fixing belt 21 can be reduced.

In order to reduce sliding friction between the heating member 22 and the fixing belt 21, a sliding surface of the heating member 22 may be made of a material having a low friction coefficient, or a surface layer made of a material containing fluorine may be formed on an inner circumferential surface 21*a* of the fixing belt 21. In FIG. 2, the heating member 22 is formed to have a substantially circular cross section. However, the heating member 22 may be formed to have a polygonal cross section.

In a case in which a means to uniformly transmit the heat from the heaters 25 to the fixing belt 21 and to ensure the running stability of the fixing belt 21 at the time of driving is separately prepared, a configuration in which a fixing device that directly heats the fixing belt 21 without including the heating member 22 is possible. In such a case, since the heat capacity of the heating member 22 is excluded from the heat capacity of the entire fixing device 20, a fixing device having more excellent temperature raising performance and energy saving performance can be configured.

The support member 23, which is a reinforcing member, reinforces and supports the securing member 26 that forms the nip. The support member 23 is fixed to the inner circumferential surface of the fixing belt 21.

Both ends of the heating member 22 in the width direction are fixed to and supported by the housing 50 of the fixing device 20 via flange members. The heating member 22 is heated by radiant heat (radiant light) of the heaters 25 to heat the fixing belt 21. That is, the heating member 22 is directly heated by the heaters 25 (heating unit), and the fixing belt 21 is indirectly heated by the heaters 25 via the heating member 22. The output of the heaters 25 is controlled based on the result of detection of the surface temperature of the fixing belt 21 by the temperature sensor 40 such as a thermistor.

Controlling the output of the heaters 25 as described above allows the temperature of the fixing belt 21 (fixing temperature) to be set to a desired temperature.

As described above, in the fixing device 20, since the fixing belt 21 is heated not only partially but also substantially entirely in the circumferential direction by the heating member 22, the fixing belt 21 is sufficiently heated even when the driving speed of the fixing device 20 is increased. Thus, the occurrence of the fixing failure can be restrained.

In FIG. 2, a halogen heater is used as an example of the heaters 25, but the type of heat source is not limited to the halogen heater, and for example, a fixing device having an induction heating source may be used.

The support member 23 is formed to have the same length in the width direction as the securing member 26, and both ends of the support member 23 in the width direction are fixed and supported by the housing 50. Since the support member 23 contacts the pressure roller 31 via the securing member 26 and the fixing belt 21, the securing member 26 is prevented from being largely deformed by the pressure of the pressure roller 31 at the fixing nip. In order to achieve the above-described function, the support member 23 is preferably formed of a metal having high mechanical strength, such as stainless steel or iron.

In a case in which the heaters 25 are heat sources that perform heating using radiant heat, such as a halogen heater, as in the present embodiment, a heat insulating member may be provided, or bright annealed (BA) finish or mirror polishing treatment may be performed on a part or a whole of the surface of the support member 23 facing the heaters 25.

With this configuration, since the radiant heat from the heaters 25 toward the support member 23 (heat to heat the support member 23) is used to heat the heating member 22, the heating efficiency of the fixing belt 21 (and the heating member 22) is further increased.

Figure 3:
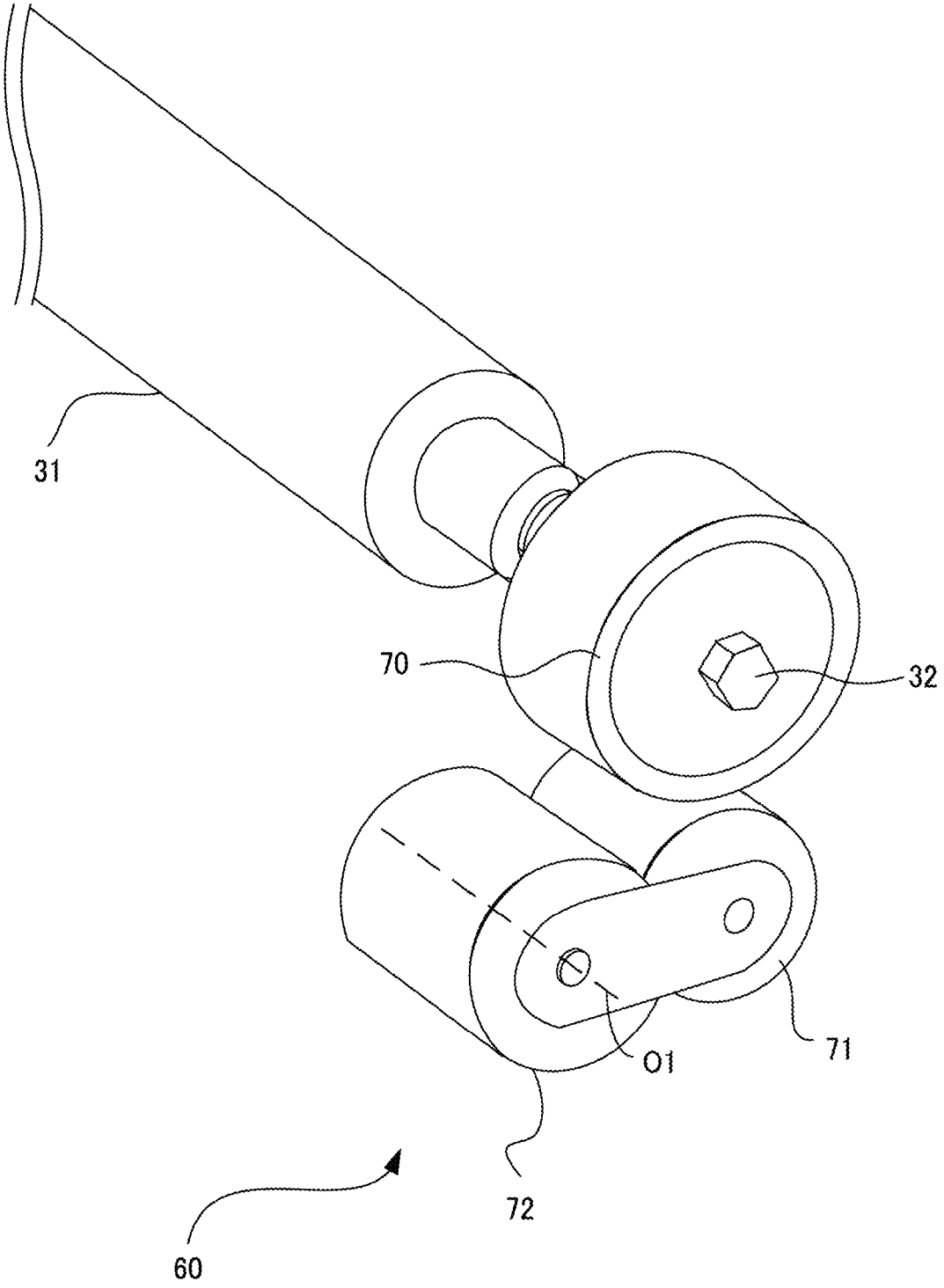
FIG. 3 is a diagram of an example of a driver constituting the fixing device illustrated in FIG. 2.
Figure 4:
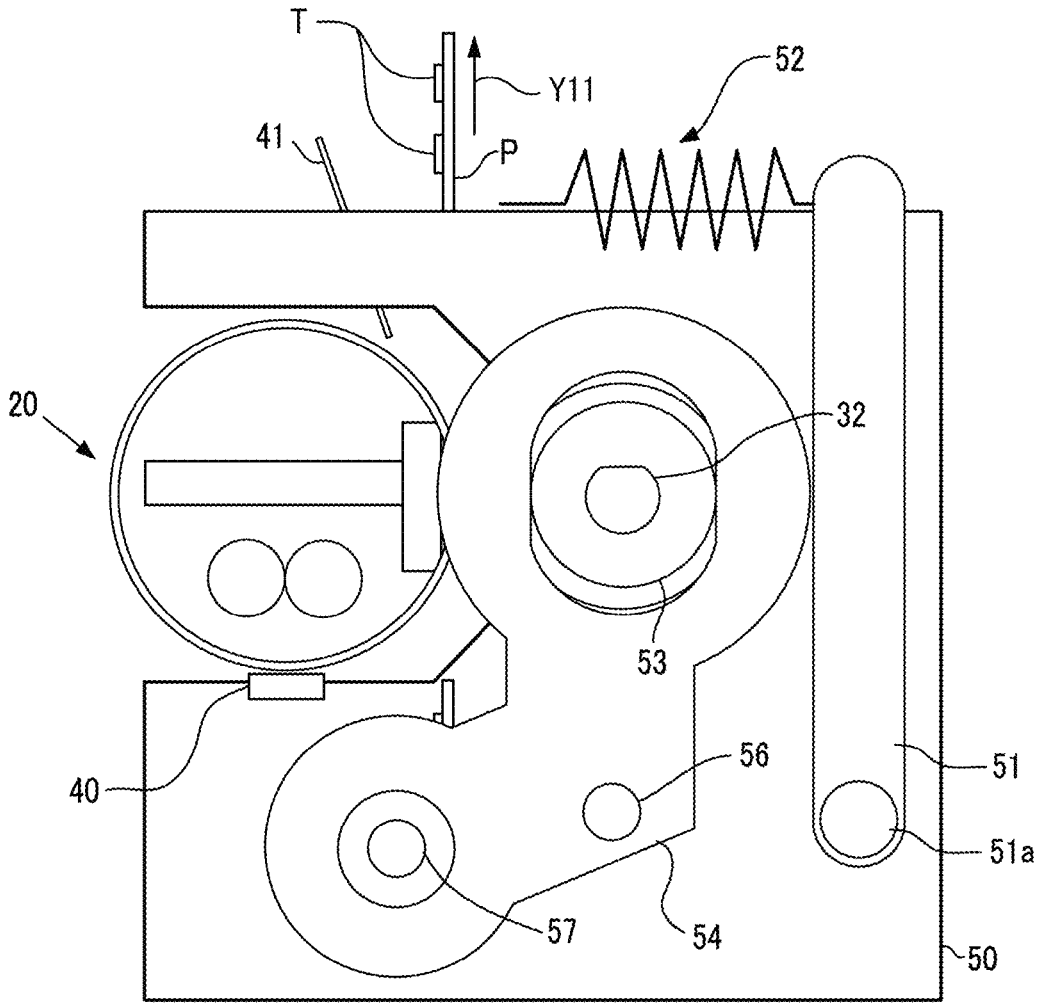
FIG. 4 is a diagram of an example of a configuration of the driver.

As illustrated in FIG. 3, the pressure roller 31 is provided with a drive gear 70 at an end of the pressure roller 31. The pressure roller 31 receives power from a motor as a driving source via a first idler gear 71 and a second idler gear 72 and is driven to rotate clockwise as illustrated in FIG. 2. As illustrated in FIG. 4, the pressure roller 31 is provided with bearings 53 at both ends of the pressure roller 31 in the width direction to restrain an increase in rotational load due to friction.

The bearings 53 are held by a drive pull-in force canceling mechanism 54 and the housing 50 to be movable in a direction perpendicular to the nip, as described below.

A heat source such as a halogen heater may be provided inside the pressure roller 31. When an elastic layer 33 of the pressure roller 31 is formed of a sponge-like material such as silicone rubber foam, the pressing force acting on the nip can be reduced. Accordingly, the deflection of the securing member 26 can be reduced.

Further, since the thermal insulation property of the pressure roller 31 is enhanced and the heat of the fixing belt 21 is hardly transferred to the pressure roller 31, the heating efficiency of the fixing belt 21 is enhanced.

In FIG. 2, the diameter of the fixing belt 21 is substantially equal to the diameter of the pressure roller 31. However, the diameter of the fixing belt 21 may be smaller than the diameter of the pressure roller 31. In such a case, since the curvature of the fixing belt 21 at the nip is smaller than the curvature of the pressure roller 31, the sheet P fed from the nip is easily separated from the fixing belt 21.

The diameter of the fixing belt 21 may be larger than the diameter of the pressure roller 31. However, the pressing force of the pressure roller 31 does not act on the heating member 22 regardless of the relationship between the diameter of the fixing belt 21 and the diameter of the pressure roller 31.

The fixing device 20 includes the pressure lever 51 and the pressure spring 52. The pressure lever 51 serves as a pressing mechanism to press the pressure roller 31 against the fixing belt 21.

The pressure lever 51 is rotatably supported by a side plate of the housing 50 around a support shaft 51*a* as a rotation center provided on one end of the pressure lever 51. A central portion of the pressure lever 51 is in contact with the bearing 53 to be able to press the pressure roller 31. The pressure spring 52 is connected to the other end of the pressure lever 51, opposite to the support shaft 51*a* of the pressure lever 51.

With such a configuration, the pressure lever 51 rotates around the support shaft 51*a*, the pressure roller 31 moves in a direction approaching the securing member 26, and the position of the pressure roller 31 is determined at a position in which a repulsive force of the pressure roller 31 and a compressive force of the pressure spring 52 are balanced. Using the pressing mechanism as described above, the pressure roller 31 can be controlled to press the fixing belt 21 to form a desired nip during a normal fixing process. During a period other than the normal fixing process (during jam clearance, standby, or the like), the pressure roller 31 can be controlled to separate from the fixing belt 21 (or reduce the pressure of the fixing belt 21). Hereinafter, a normal operation of the fixing device 20 configured as described above is briefly described.

When the power switch of the image forming apparatus 1 is turned on, electric power is supplied to the heaters 25, and the pressure roller 31 starts rotating in the clockwise direction in FIG. 2. Accordingly, the fixing belt 21 is also driven to rotate in the counterclockwise direction in FIG. 2 by the frictional force with the pressure roller 31.

When the sheet P as a recording medium is fed from the sheet feeding unit 12 as described above, an unfixed color image is carried (transferred) onto the sheet P at a position of the secondary transfer roller 89. The sheet P bearing the unfixed image (toner image T) is conveyed along a conveyance path of the image forming apparatus 1 in a direction indicated by arrow Y10 in FIG. 2 while being guided by a guide plate, and is fed into the nip between the fixing belt 21 and the pressure roller 31. The fixing belt 21 is heated by the heaters 25 and the heating member 22 heated by the heaters 25. The toner image T is fixed on the surface of the sheet P by the heat of the fixing belt 21 and the pressing force between the securing member 26 reinforced by the support member 23 and the pressure roller 31.

Thereafter, the sheet P is separated from the fixing belt 21 by the separator 41, conveyed in a direction indicated by arrow Y11, and ejected from the fixing device 20 as described above.

In the fixing nip formed by the pressure roller 31 and the fixing belt 21, the pressure roller 31 needs to be driven to rotate. Therefore, in the present embodiment, the fixing device 20 includes a driver 60 to rotationally drive the pressure roller 31.

Figure 5:
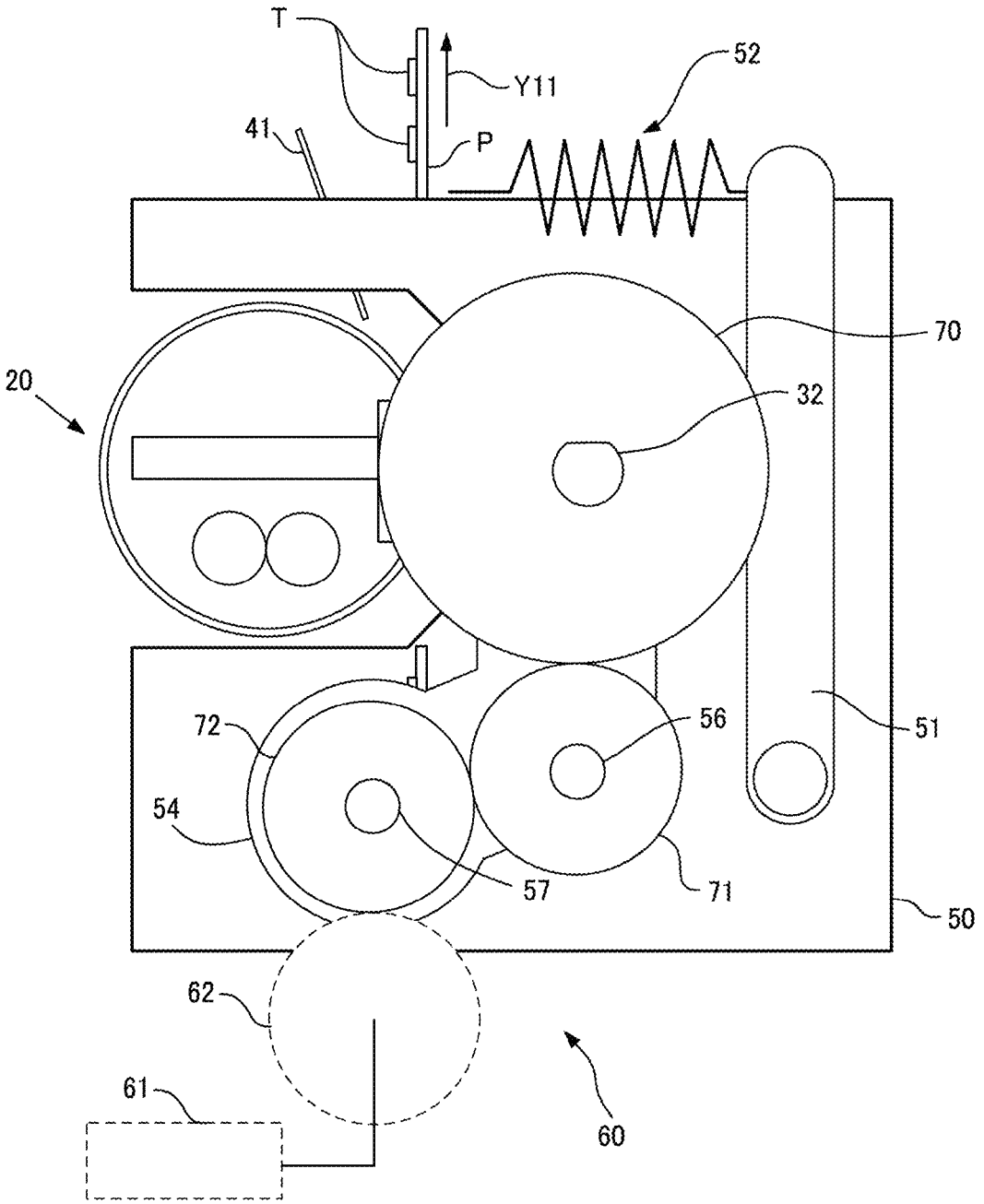
FIG. 5 is a diagram of an example of meshing of idler gears constituting a part of the driver.

As illustrated in FIG. 5, the driver 60 includes a motor 61, a gear 62, the drive gear 70, and a pair of idler gears, the first idler gear 71 and the second idler gear 72, as a part of the driver 60 of the pressure roller 31. The gear 62 transmits a driving force from the motor 61.

The driver 60 also includes the drive pull-in force canceling mechanism 54, which will be described in detail later.

The drive gear 70 is a spur gear or a helical gear that is provided around the rotation shaft of the pressure roller 31 and rotates together with the pressure roller 31.

The first idler gear 71 is an idler gear that meshes with the drive gear 70. The first idler gear 71 is inserted through around the rotation center of a shaft 56 provided in the drive pull-in force cancellation mechanism 54 and is rotatably held by the shaft 56, as described later.

The second idler gear 72 meshes with the first idler gear 71, and the drive gear 70 meshes with the first idler gear 71, thereby constituting a gear set that transmits the driving force from the motor 61 to the drive gear 70. In FIG. 5, the gear 62 that transmits the driving force from the motor 61 is indicated by a dashed line.

As an example, when the gear 62 rotates counterclockwise in FIG. 5, the second idler gear 72 rotates clockwise, the first idler gear 71 rotates counterclockwise, the drive gear 70 rotates clockwise, and the pressure roller 31 also rotates clockwise.

Typically, for a driver such as the driver 60, a configuration in which one end of the pressure roller 31 is driven is well known, for example. In such a configuration, it is known that a force called a pull-in force to draw the pressure roller 31 toward a nip direction is generated by a driving force applied to the one end of the pressure roller 31.

Figure 6:
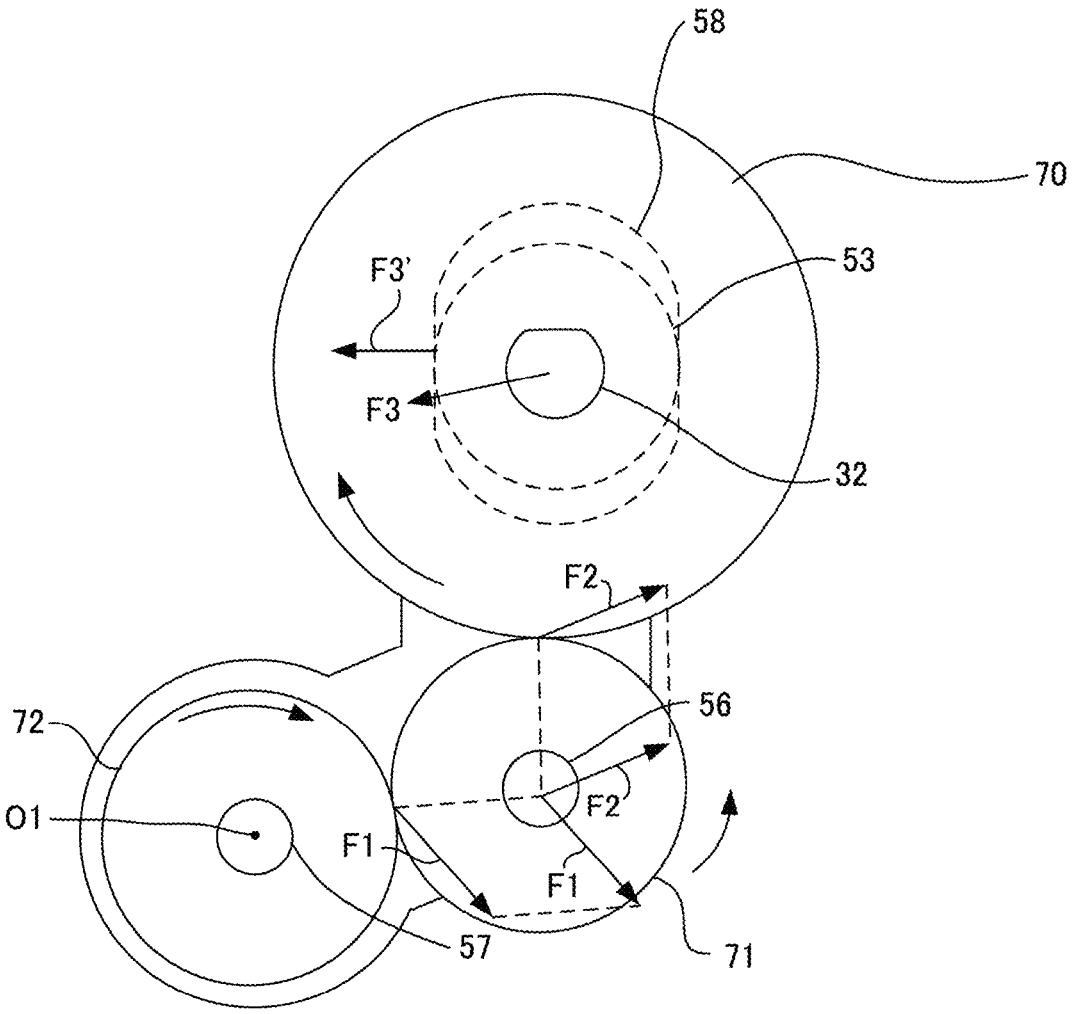
FIG. 6 is a diagram of an example of a force generated by rotational driving of the driver.

That is, it is known that when a driving force F3 is applied to the drive gear 70 by the rotation of the motor 61, a pull-in force F3' to draw the pressure roller 31 toward the nip direction is generated, as illustrated in FIG. 6.

Since the pull-in force F3' is very weak on a non drive-gear end of the pressure roller 31, that is, the end of the pressure roller 31 opposite to the drive gear 70, only the end of the pressure roller 31 closer to the drive gear 70 is subjected to a force to be drawn toward the nip direction by the pull-in force F3'. In a conventional configuration, the nip width and the nip load are not uniform due to the pull-in force F3'. Further, if the fixing belt 21 having flexibility as in the present embodiment is used, the applied torque increases due to a bias of the applied force. Accordingly, undesirably, an image defect such as a fixing failure or damage to the fixing belt 21 may occur.

Figure 7:
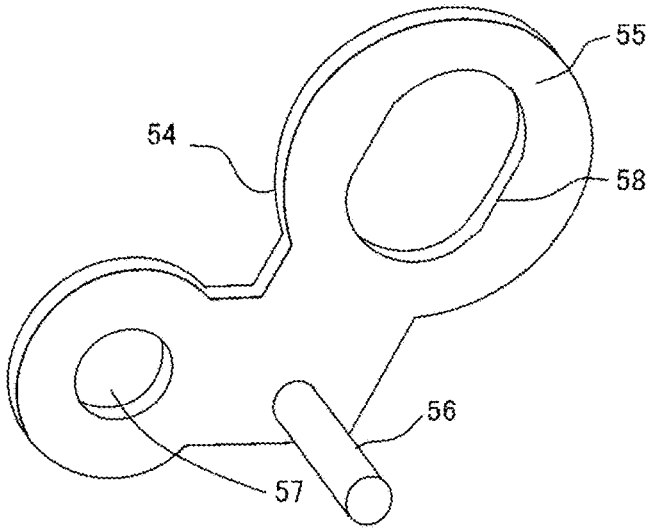
FIG. 7 is a diagram of an example of a configuration of a drive pull-in force canceling mechanism.

Therefore, in the present embodiment, the driver 60 includes the drive pull-in force canceling mechanism 54 as illustrated in FIG. 7 as a pivot member that rotates to cancel such a pull-in force.

The drive pull-in force canceling mechanism 54 is formed of a plate-shaped metal in which a holding member 55 that holds the bearing 53, the shaft 56 of the first idler gear 71, and the rotation center O1 of the second idler gear 72 are integrated.

Particularly in the present embodiment, a gap portion 57 into which the rotation center O1 of the second idler gear 72 is fitted is formed such that the rotation center O1 of the second idler gear 72 coincides with the rotation center O1 of the drive pull-in force canceling mechanism 54.

The operation of the drive pull-in force canceling mechanism 54 according to the present embodiment is now described in detail with reference to FIG. 8.

Figure 8:
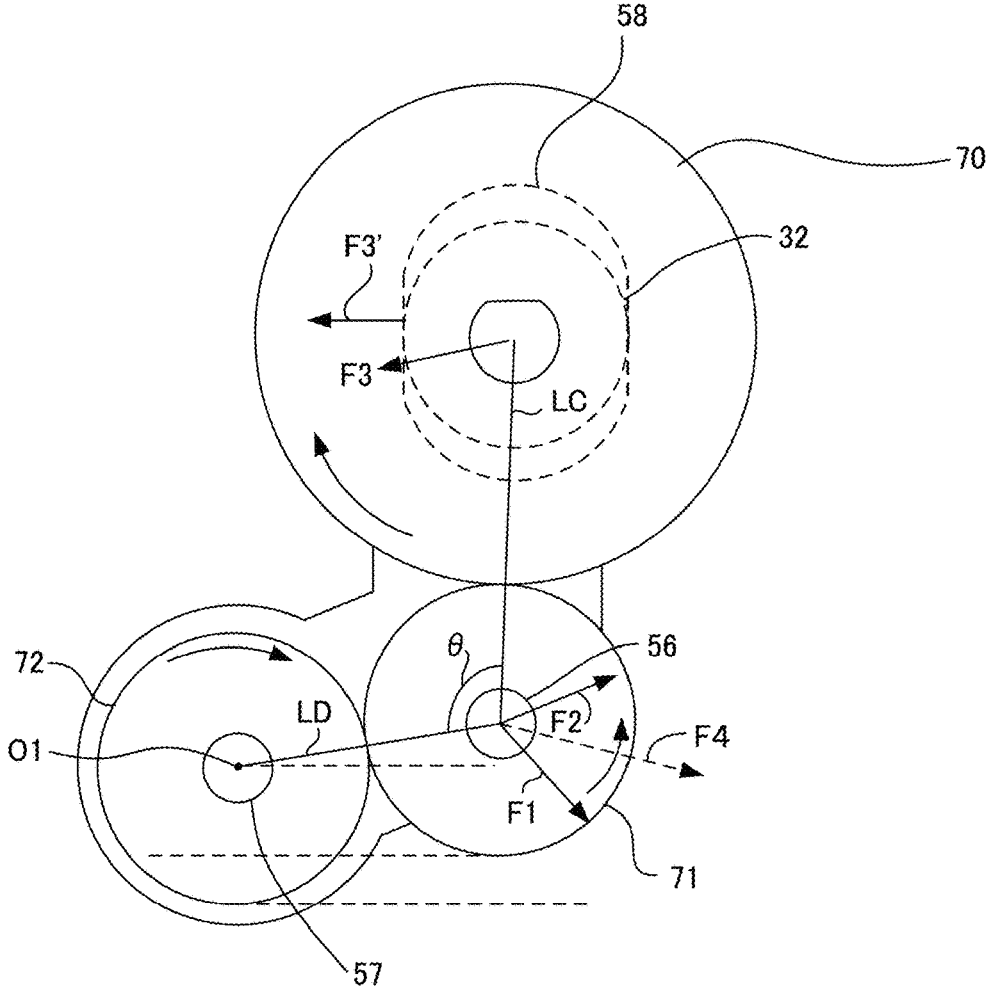
FIG. 8 is a diagram of an example of an operation of the drive pull-in force canceling mechanism.

As illustrated in FIG. 8, the first idler gear 71 is rotatably held by the shaft 56. That is, the shaft 56 is a stud-shaped member having a function as an idler gear support portion to rotatably support the first idler gear 71.

A driving force F1 by which the second idler gear 72 drives the first idler gear 71 and a driving force F2 by which the first idler gear 71 drives the drive gear 70 are applied to the shaft 56.

At this time, in the drive pull-in force canceling mechanism 54, a resultant force F4 indicated by a dashed line extending in a right direction of FIG. 8 is generated as a resultant force of the driving force F1 and the driving force F2 with respect to the shaft 56.

In the present embodiment, since the rotation center O1 of the drive pull-in force canceling mechanism 54 is also the rotation center of the second idler gear 72, the resultant force F4 is a force that rotates the drive pull-in force canceling mechanism 54 in the clockwise direction.

The clockwise rotational force acts toward a direction to separate the pressure roller 31 from the fixing nip via the holding member 55 and the bearings 53.

On the other hand, with respect to a driving force F3 that drives the drive gear 70 by the first idler gear 71, a projection indicated by an arrow extending in a left direction in FIG. 8 is the pull-in force F3'.

The drive pull-in force canceling mechanism 54 is required to determine a position of the rotation center O1, a position of the shaft 56, and the like so that the pull-in force F3' and a component of the resultant force F4 acting toward a direction in which the pressure roller 31 is separated from the fixing nip are canceled well.

Figure 9:
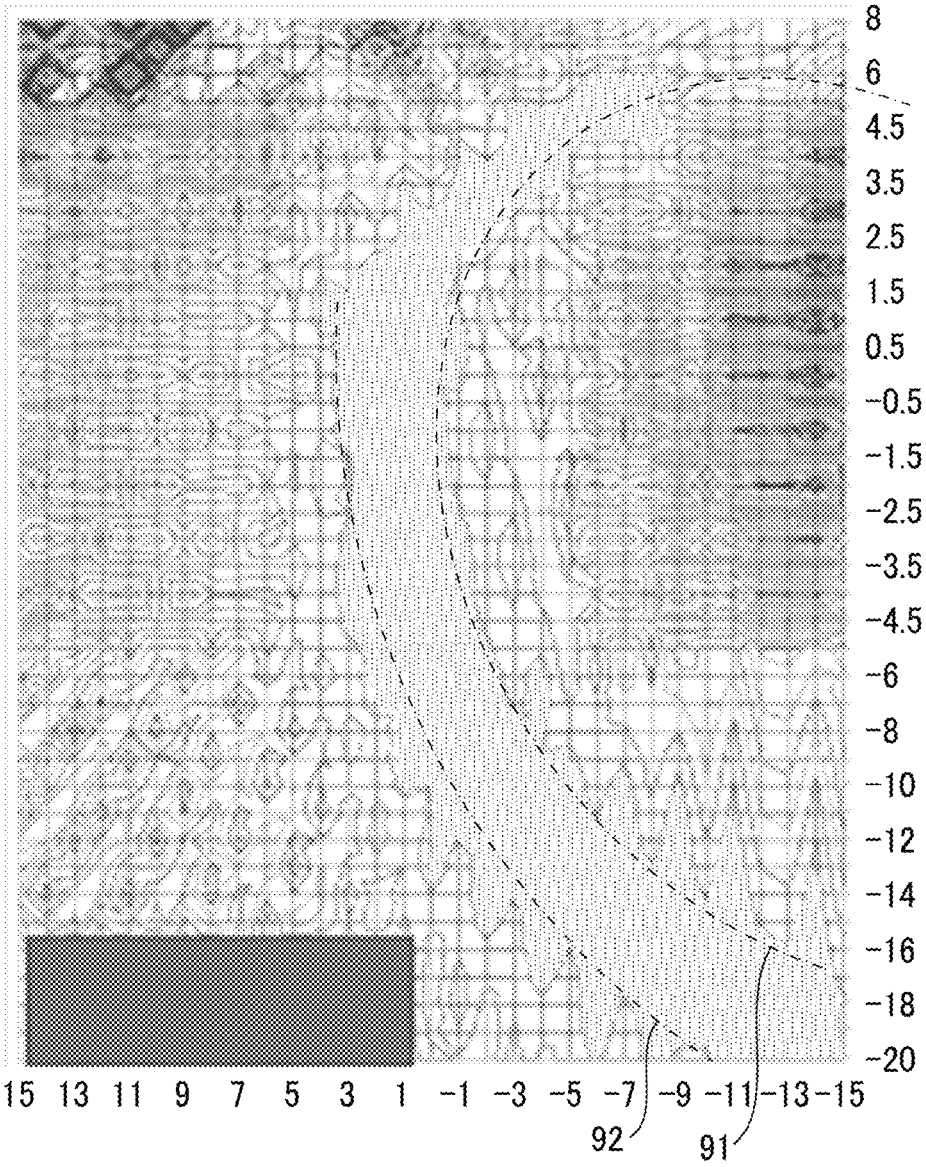
FIG. 9 is a view of an example of a simulation result of a pull-in force reduced by the drive pull-in force cancellation mechanism.

Therefore, the inventor has visualized residual pull-in force rates when the position of the rotation center O1 of the drive pull-in force canceling mechanism 54 is variously changed, with the percentage of the pull-in force after being canceled by the drive pull-in force canceling mechanism 54 with respect to the pull-in force F3' as the residual pull-in force rate. Thus, FIG. 9 has been obtained. In FIG. 9, a range filled with a stipple pattern is a desirable range in which the pull-in force residual rate of 5% or less can be achieved in the present embodiment.

Further analysis of FIG. 9 reveals that the desirable range of the rotation center O1 is between a line connecting the shaft 56 as the center of the first idler gear 71 and the rotation center of the drive gear 70 (i.e. the center of the bearing 53), an involute curve (a first involute curve 91) of the reference circle of the first idler gear 71 starting from a contact point of the reference circle of the first idler gear 71, and a second involute curve 92 that is slid so that a starting point of the first involute curve 91 serves as a contact point with the first involute curve 91 and the reference circle of the drive gear 70.

In the simulation of FIG. 9, it is assumed that pressure angles of all the gears of the drive gear 70, the first idler gear 71, and the second idler gear 72 are 20 degrees, and a straight line connecting the rotation center of the drive gear 70 and the rotation center of the first idler gear 71 is within the range of 90°±5° with respect to a straight line parallel to the ground on which the driver 60 is installed. In the present embodiment, since the fixing device 20 conveys the sheet P in a vertical direction as illustrated in FIG. 1, the angle is set in the range of 90°±5° with respect to the straight line parallel to the ground, but the angle may be set in the range of 90°±5° with respect to the direction in which the pressure roller 31 moves when contacting and separating from the fixing belt 21. In such an arrangement in which the angles are set within the above described range, since contact and separation directions are generally perpendicular to the conveyance direction, the drive gear 70 and the first idler gear 71 are arranged in a direction along the conveyance direction of the sheet P, contributing to downsizing of the driver 60.

Figure 10:
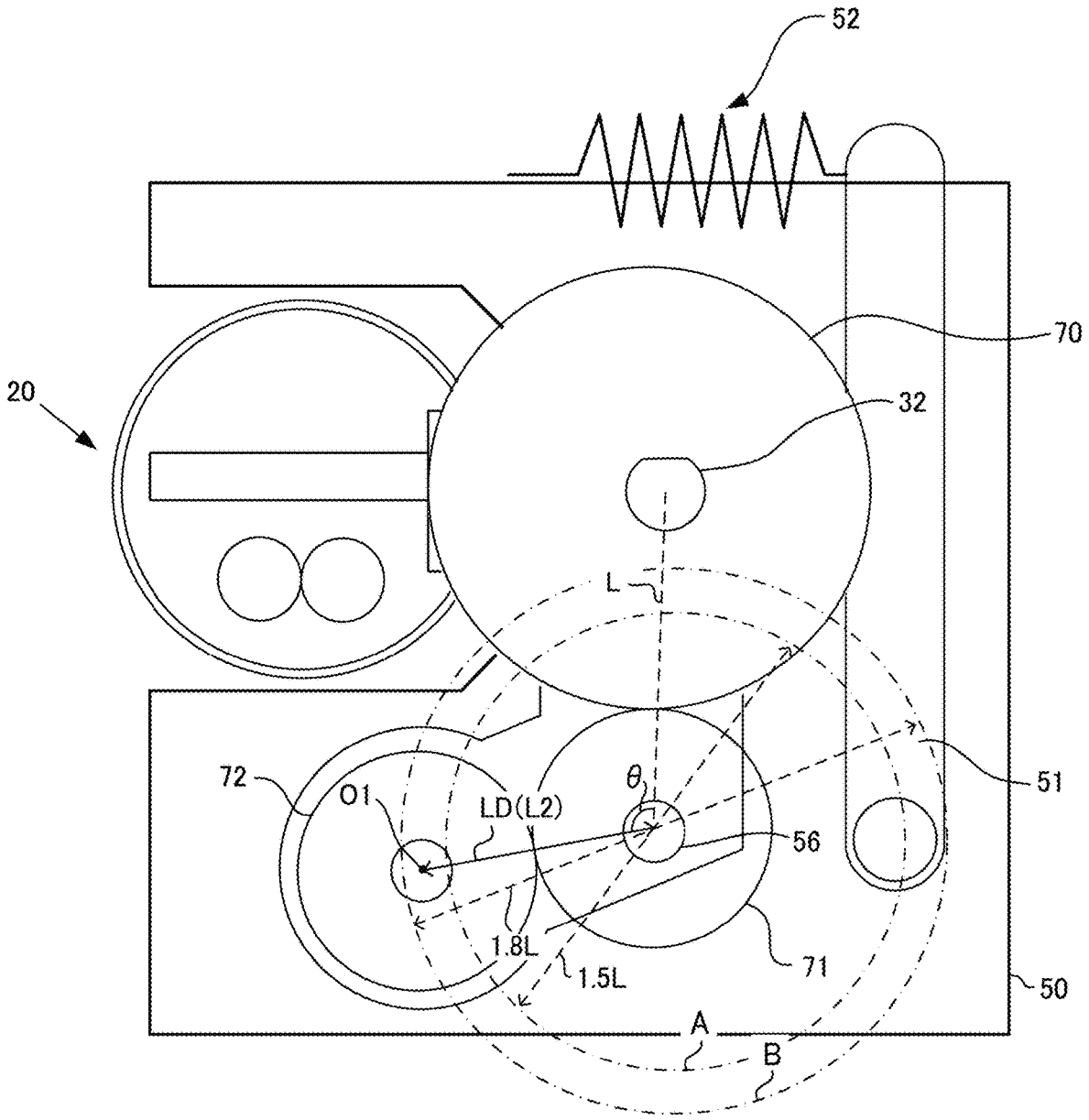
FIG. 10 is a diagram of an example of a suitable arrangement of the idler gears derived from the simulation result illustrated in FIG. 9.

FIG. 10 schematically illustrates an actual positional relationship between the position of the shaft 56 and the rotation center O1 based on the result of FIG. 9.

As apparent from FIG. 10, when a distance between the rotation center of the drive gear 70 (i.e., the center of the bearing 53) and the shaft 56 as the rotation center of the first idler gear 71 is L, the rotation center O1 of the drive pull-in force canceling mechanism 54 is more preferably present in a region outside a circle A having a diameter of 1.5×L indicated by a dashed line in FIG. 10 and inside a circle B having a diameter of 1.8×L around the shaft 56.

In other words, when a distance between the center of the bearings 53 of the pressure roller 31 and the center of the shaft 56 is L, the center of the gap portion 57 or the rotation center O1 of the second idler gear 72 is desirably positioned so that the distance L2 from the shaft 56 falls within the range of $0.90L \geq L2 \geq 0.75L$.

Further, in the present embodiment, the pressure angles of all of the drive gear 70, the first idler gear 71, and the second idler gear 72 are 20 degrees. The term "pressure angle" as used herein refers to an angle formed between a radial line and a tangent to the tooth profile at one position (usually, pitch point) on the tooth surface.

In the present embodiment, the bearings 53 are held by the housing 50 on one bearing 53 side and by the drive pull-in force canceling mechanism 54 on the other bearing 53 side to be movable in the vertical direction from the fixing nip.

With this configuration, a portion of the force acting in the vertical direction in the projection of the driving force F3 is buffered by a vertical movement between the drive pull-in force canceling mechanism 54 and the bearings 53, and the influence of the force other than the pull-in force F3' on the drive pull-in force canceling mechanism 54 can be reduced.

Further, in the present embodiment, a straight line LC connecting the rotation center of the drive gear 70 and the rotation center of the first idler gear 71 is within the range of 90°±5° with respect to a straight line parallel to the ground on which the driver 60 is installed.

According to this configuration, a fitting between the bearing 53 and the holding member 55 is freely movable in the substantially vertical direction, and enables the drive pull-in force canceling mechanism 54 also to move along with the movement of the bearings 53 in the horizontal direction with respect to the vertical direction, as illustrated in FIG. 8. In other words, the holding member 55 includes a fitting portion 58 to receive the bearings 53, which is formed in an elongated hole shape in the vertical direction to the ground surface on which the driver 60 is installed.

Further, in the present embodiment, the center of the second idler gear 72 is disposed above a lowermost portion of the addendum circle of the first idler gear 71 in the vertical direction.

In FIG. 8, in order to generate a force in the clockwise direction by the resultant force F4, it is important that the position of the shaft 56 is above the rotation center O1.

Further, desirably the position of the rotation center O1 of the second idler gear 72 is disposed above the lowermost portion of the addendum circle of the first idler gear 71 in the vertical direction.

With this configuration, the drive pull-in force cancellation mechanism 54 can be provided within a narrow range in the vertical direction, which contributes to downsizing of the driver 60.

In the present embodiment, the drive gear 70, the first idler gear 71, and the second idler gear 72 are disposed such that an angle θ formed between a straight line LC connecting the rotation center of the first idler gear 71 and the rotation center of the second idler gear 72 and a straight line LD connecting the rotation center of the second idler gear 72 and the rotation center of the first idler gear 71 is 100° or less.

With this configuration, the drive pull-in force cancellation mechanism 54 can be provided while the drive gear 70, the first idler gear 71, and the second idler gear 72 are disposed close to each other, which contributes to downsizing of the driver 60.

The above-described embodiments are illustrative and do not limit the present disclosure. Thus, numerous additional modifications and variations are possible in light of the above description. For example, elements and/or features of different illustrative embodiments may be combined with each other and/or substituted for each other within the scope of the present disclosure.

For example, in the present embodiment, only the driver 60 incorporated in the fixing device 20 has been described as a part of the image forming apparatus 1. However, a generic driver or a fixing device may be applied to the present disclosure.

The effects described in the embodiments of the present disclosure are listed as examples of most preferable effects derived from the present disclosure, and therefore are not limited to the effects described above.

The suffixes Y, M, C, and K attached to each reference numeral indicate only that components indicated thereby are used for forming yellow, magenta, cyan, and black images, respectively, and hereinafter may be omitted when color discrimination is not necessary.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present disclosure.

What is claimed is:

1. A driver comprising:

a first rotator:

a second rotator configured to form a nip with the first rotator;

a bearing rotatably holding a shaft portion of the first rotator;

a housing holding the bearing such that the first rotator is movable along a direction to contact and separate from the second rotator;

a drive gear provided on the shaft portion of the first rotator and configured to rotate together with the first rotator;

a first idler gear meshed with the drive gear;

a pivot member configured to pivot around a rotation center axis in the housing, the pivot member including an idler gear support portion rotatably holding the first idler gear; and a second idler gear meshed with the first idler gear and disposed on the rotation center axis of the pivot member, wherein a rotation center of the pivot member is present in a region outside a circle having a diameter of 1.5×L and inside a circle having a diameter of 1.8×L around a rotation center of the first idler gear, when a distance between a rotation center of the first rotator and the rotation center of the first idler gear is defined as L.

2. The driver according to claim 1, wherein a pressure angle of each of the drive gear, the first idler gear, and the second idler gear is 20°.

3. The driver according to claim 1, wherein the bearing is held by the housing and the pivot member to be movable in a vertical direction from the nip formed by the first rotator and the second rotator.

4. The driver according to claim 1, wherein a straight line connecting a rotation center of the drive gear and the rotation center of the first idler gear is included in an angle within a range of 90°±5° with respect to the direction along which the first rotator moves to contact and separate from the second rotator.

5. The driver according to claim 1, wherein a center of the second idler gear is disposed above a lowermost portion of an addendum circle of the first idler gear in a vertical direction.

6. The driver according to claim 1, wherein an angle formed by a straight line connecting a rotation center of the drive gear and the rotation center of the first idler gear and a straight line connecting a rotation center of the second idler gear and the rotation center of the first idler gear is 100° or less.

7. A fixing device comprising:

the driver according to claim 1; and a heating source provided in at least one of the first rotator and the second rotator, wherein the fixing device is configured to press and heat an image formed on a recording medium to fix the image on the recording medium in the nip.

8. An image forming apparatus comprising the driver according to claim 1.

9. An image forming apparatus further comprising:

an image forming device configured to form a toner image on a recording medium; and the fixing device according to claim 7 configured to fix the toner image on the recording medium.

* * * * *